US010246218B2

(12) United States Patent
Ramsey et al.

(10) Patent No.: US 10,246,218 B2
(45) Date of Patent: Apr. 2, 2019

(54) NECKED BEVERAGE CAN HAVING A SEAMED-ON END

(71) Applicant: Crown Packaging Technology, Inc., Alsip, IL (US)

(72) Inventors: Christopher Paul Ramsey, Oxfordshire (GB); Laura Jane McGirr, Derry (GB); Brian Fields, Lemont, IL (US)

(73) Assignee: Crown Packaging Technology, Inc., Alsip, IL (US)

( * ) Notice: Subject to any disclaimer, the term of this patent is extended or adjusted under 35 U.S.C. 154(b) by 365 days.

(21) Appl. No.: 14/773,892

(22) PCT Filed: Mar. 12, 2014

(86) PCT No.: PCT/US2014/023933

§ 371 (c)(1),
(2) Date: Sep. 9, 2015

(87) PCT Pub. No.: WO2014/150673

PCT Pub. Date: Sep. 25, 2014

(65) Prior Publication Data

US 2016/0031594 A1 Feb. 4, 2016

Related U.S. Application Data

(60) Provisional application No. 61/787,191, filed on Mar. 15, 2013.

(51) Int. Cl.

| | |
|---|---|
| ***B65D 17/40*** | (2006.01) |
| ***B65D 17/28*** | (2006.01) |
| ***B65D 17/00*** | (2006.01) |

(52) U.S. Cl.
CPC ..... *B65D 17/4012* (2018.01); *B65D 17/02* (2013.01); *B65D 17/08* (2013.01); *B65D 2517/0013* (2013.01)

(58) Field of Classification Search
CPC ..... B65D 17/165; B65D 17/02; B65D 17/08; B65D 2517/0013
USPC ..... 220/269, 619
See application file for complete search history.

(56) References Cited

U.S. PATENT DOCUMENTS

| | | | |
|---|---|---|---|
| 3,608,774 | A | 9/1971 | Saunders |
| 3,795,340 | A | 3/1974 | Hougen et al. |
| 3,858,754 | A | 1/1975 | Patarini et al. |
| 3,934,750 | A | 1/1976 | Herbst |
| 3,967,754 | A | 7/1976 | Ostrem |
| 4,014,455 | A | 3/1977 | LaCroce |
| 4,318,493 | A | 3/1982 | Jacobsen et al. |
| D272,508 | S | 2/1984 | Conti |

(Continued)

FOREIGN PATENT DOCUMENTS

| | | | |
|---|---|---|---|
| CN | 2583002 | Y | 10/2003 |
| CN | 1902095 | A | 1/2007 |
| WO | WO 2013/172783 | A1 | 11/2013 |

OTHER PUBLICATIONS

Chinese Patent Application No. 201480028130.4: First Office Action dated Oct. 24, 2016, 8 pages.

*Primary Examiner* — James N Smalley
(74) *Attorney, Agent, or Firm* — BakerHostetler

(57) ABSTRACT

A beverage can for carbonated soft drinks, beer, and other pressurized uses includes a drawn and ironed can body, a highly necked portion, and an relatively small end that is attached to the can body by a double seam.

41 Claims, 4 Drawing Sheets

(56) References Cited

U.S. PATENT DOCUMENTS

| | | | | |
|---|---|---|---|---|
| D275,834 | S | 10/1984 | Slade | |
| 4,550,851 | A | 11/1985 | Garrett et al. | |
| 4,564,119 | A | 1/1986 | Tsuge et al. | |
| 5,346,087 | A * | 9/1994 | Klein | B65D 17/161 220/268 |
| 5,355,710 | A * | 10/1994 | Diekhoff | B21D 51/2615 220/669 |
| 5,572,893 | A | 11/1996 | Goda et al. | |
| 5,645,190 | A | 7/1997 | Goldberg | |
| 5,704,240 | A * | 1/1998 | Jordan | B21D 15/04 72/103 |
| 6,499,622 | B1 | 12/2002 | Neiner | |
| 6,877,941 | B2 | 4/2005 | Brifcani et al. | |
| D587,137 | S | 2/2009 | Hayden et al. | |
| D605,060 | S | 12/2009 | Reimer | |
| D622,145 | S | 8/2010 | Walsh | |
| 7,819,275 | B2 | 10/2010 | Stodd et al. | |
| D632,588 | S | 2/2011 | George | |
| D638,708 | S | 5/2011 | Walsh | |
| RE42,485 | E | 6/2011 | Fields | |
| D639,164 | S | 6/2011 | Walsh | |
| D653,538 | S | 2/2012 | Toms et al. | |
| 8,109,406 | B2 | 2/2012 | Chang | |
| 8,157,119 | B2 | 4/2012 | Watson et al. | |
| D688,553 | S | 8/2013 | Winstanley et al. | |
| D701,464 | S | 3/2014 | Ogata et al. | |
| D707,568 | S | 6/2014 | Stephens et al. | |
| D707,569 | S | 6/2014 | Stephens et al. | |
| 8,939,308 | B2 | 1/2015 | Ramsey | |
| 2002/0139800 | A1 | 10/2002 | Hwang et al. | |
| 2004/0056032 | A1 | 3/2004 | Vaughan | |
| 2004/0129710 | A1 | 7/2004 | Q | |
| 2005/0109787 | A1 | 5/2005 | Q | |
| 2008/0099480 | A1 | 5/2008 | Q | |
| 2011/0056945 | A1* | 3/2011 | Ramsey | B65D 17/163 220/269 |
| 2011/0303672 | A1* | 12/2011 | Fields | B21D 51/383 220/269 |
| 2015/0239607 | A1* | 8/2015 | Fields | B65D 17/163 220/272 |

* cited by examiner

NECKED BEVERAGE CAN HAVING A SEAMED-ON END

CROSS-REFERENCE TO RELATED APPLICATIONS

This application is the National Stage of International Application No. PCT/US2014/023933, filed Mar. 12, 2014, which claims the benefit of U.S. provisional application number 61/787,191, filed Mar. 15, 2013, the disclosures of which are incorporated herein by reference in their entirety.

FIELD OF THE INVENTION

The present invention relates to containers, and more particularly to drawn and ironed beverage containers.

BACKGROUND

Two-piece aluminum beverage cans are produced in vast quantities for holding carbonated soft drinks and beer. The cans include a can body on which a can end is attached by a seam. Commercial two piece beverage cans are formed by a well-known drawing and ironing process (also known as a drawn wall ironing or DWI process) that first draws an aluminum blank into a cup and then irons the walls of the cup to form the can body in a machine named a body maker.

The industry convention of can sizes employs three digits to represent inches and the quantity of 16th inches. Thus, a 211 can body has a nominal 2 and 11/16 inch diameter. As is understood in the art, and as employed throughout this disclosure, nominal beverage can end sizes do not refer to exact measurements to the outside of the seam. Rather, the nominal size is an industry standard that no longer corresponds to exact diameter because the beverage industry switched to the seaming technology generally referred to as a "mini-seam." In this regard, the nominal size refers generally to the diameter of the outside of the seam plus reduction in the diameter corresponding with the change from an old double seam to a modern, mini-seam.

The most popular beverage can size is 12 ounce in the United States and 330 ml in Europe. A 12 ounce beverage can has a 211 body diameter, ends typically sized at 202 to 206, and height of 4.8 inches. A 330 ml can typically has ends like those in the U.S. and typically has a height of 114 mm. Thinner taller beverage cans are also commercially available. Cans referred to as sleek cans typically have a 206.5 body and a height of 114 mm or 145 mm for a 250 ml or 330 ml capacity in Europe. Cans referred to as slim cans typically have 53 3 mm or 202 diameter and a 88 mm, 111 mm, or 134 mm height for 150 ml, 200 ml, or 250 ml cans. Traditional beverage cans typically have ends that are 202 to 206 size, sleek can end sizes are usually 202, and slim can end sizes are usually 200.

The end sizes of the above cans are smaller than the can body diameters because the can body undergoes a necking operation in which the diameter of the open end is reduced in several stages. For example, the necking operation may reduce the can body diameter from a 211 size to a diameter than may be seamed with a 206, 204, or 202 end. After necking, the can end is attached to the can body in a well-known seaming process. Moreover, can ends can be the full aperture type, in which the tab is coupled to the removable panel, and of the stay-on-tab type, in which the tab affixed to a non-removable center panel is actuated to rupture a score to form a hinged tear panel.

U.S. Pat. No. 8,109,406 discloses an end on a tapered can neck. In a first embodiment, a tab includes an elongate body to which a rivet is attached, a heel at one end of the tab body, and a nose at an opposing end of the body. The rivet is offset from the centerline of the end opposite the tear panel that forms the opening. In other words, in the prior art end, the center of the end is between the rivet and the tear panel. To open it, a user pivots the end over the seam of the can such that the heel is cantilevered in space. In other embodiments in the U.S. Pat. No. 8,109,406, a user grips an end of an unconventional pull tab to bend the tab at a hinge until a portion of the tab is upright. The score is opened upon the second step of pulling the tab straight up to apply a downward force through a puncturing nose. Based on rough scaled dimension in the drawings, the embodiments of the U.S. Pat. No. 8,109,406 disclose a can body sidewall diameter that is approximately 105% to 115% greater than the end diameter.

In addition to conventional metal beverage cans, beverages (especially beer) are commercially supplied in drawn and ironed metal bottles and in impact extruded metal bottles. A metal bottle, which is commercially manufactured under the trade name Alumitek™, has a drawn and ironed 211 can body and a neck that tapers to a threaded, roll-on pilfer-proof (ROPP) 38 mm (1.5 inch) closure. United States Design patents D639,164; D638,708; and D622,145 illustrate the bottle shape and threaded neck and closure.

Commercial metal bottles are also formed by an impact extrusion process in which a slug of aluminum or an aluminum alloy is placed in a cylindrical die and struck with a punch at high pressure. The metal of the slug then flows upwardly to form a thin-wall open ended container that usually has bead for a pry off cap. U.S. Pat. No. 5,572,893 discloses an impact extruded bottle having threads. Drawn and ironed can body walls typically are significantly thinner than impact extrusion can walls.

SUMMARY OF THE INVENTION

The present invention combines features from metal bottles and drawn and ironed metal cans for holding a carbonated soft drink, beer, and like beverages that subject the can to internal pressure of greater than 65 psi—usually rated for greater than 85 psi. The appearance and drinking experience of containers describe herein are similar to a metal bottle, while the manufacturing speed and system economics are similar to or better than conventional beverage cans.

Containers having the configuration described herein have an advantage of metal content per unit volume compared with metal bottles and conventional 211 cans. In this regard, containers having the inventive configuration use approximately only 50% of the metal required to produce drawn and ironed metal bottles and around 25% of the metal required to produce impact extruded metal bottles. For example 33 cl bottles made by impact extrusion weigh approximately 50 g, drawn and ironed metal bottles weigh approximately 25 g, and a 33 cl container described herein weighs only around 11.5 g. Further, the overall weight and material utilization is also significantly better than conventional 211 drawn and ironed beverage cans (such as the conventional 12 ounce cans) of the same capacity and performance criteria. A factor in metal utilization is the cost of the metal, which favors the configurations described herein because much of the metal saving is in the can end, which typically is formed of a more expensive alloy than that of the can body. In general, the improvement in metal reduction and metal utilization is due to the short tapered neck (as reflected, for example, in neck angle), small end, and small seam diameter compared with metal bottles and conventional metal beverage cans.

Further, the container bodies described herein can be produced at commercial line speeds by drawing and ironing, and later by necking, using conventional DWI and necking equipment. Thus, the speed at which the containers described herein can be produced is significantly higher than the production rates of metal bottle can bodies. And because the containers described herein can employ a conventional double seaming process, as distinguished from requiring a thread forming operation and ROPP closure application operation, line speeds at the filler are greater than for bottle cans.

A beverage can according to an aspect of the invention includes: a drawn an ironed, metal beverage can body including a base, a cylindrical sidewall extending upwardly from the base, and a tapering neck extending upwardly from the sidewall; the base including a standing ring and a dome located within the standing ring; an end seamed together with an upper end of the neck, the end including a center panel located within the seam, and a sealed pour aperture formed in the center panel. The sealed pour aperture is adapted for being opened without tools by a consumer. The can body has a diameter that is between 40% and 100% greater than a diameter of the seamed end. A ratio between can body diameter measured in units of inches and average can wall thickness measured in units of ten-thousandths of an inch may be less than approximately 25.

According to another aspect of the invention, the beverage can includes: a drawn an ironed, metal beverage can body including a base, a cylindrical sidewall extending upwardly from the base, and a tapering neck extending upwardly from the sidewall; the base including a standing ring and a dome located within the standing ring; an end seamed together with an upper end of the neck, the end including a center panel located within the seam, a sealed pour aperture formed in the center panel, the sealed pour aperture is adapted for being opened without tools by a consumer; wherein a ratio between can body diameter measured in units of inches and average can wall thickness measured in units of ten-thousandths of an inch is less than approximately 25. The can body may have a diameter that is between 40% and 100% greater than a diameter of the seamed end.

For either embodiment of the can bodies, the sealed pour aperture is a score formed in the center panel, and the end further includes a tab coupled to the center panel by a rivet. The can end can be a full aperture-type can end. And a score of the center panel that defines a pour opening can be capable of being opened upon lifting the tab while the tab is located entirely within the seam. The can body diameter can be between 40% and 80% greater than the diameter of the seamed end, more preferably between 45% and 60% greater than the diameter of the seamed end, and even more preferably between 48% and 55% greater than the diameter of the seamed end.

The can neck can be substantially straight in cross section between (i) a transition between the neck and the can body sidewall and (ii) a transition between the neck and the seam. Or the neck can include curved portions in cross section between the transition between the neck and the can body sidewall and the transition between the neck and the seam, such that no tangent at any point on the curve is inclined more than 45 degrees. And the neck can be formed by several step bumps. Regardless of the neck configuration, the neck can be inclined from vertical by an angle of between greater than 15 degrees, or between approximately 15 degrees and approximately 45 degrees, between approximately 20 degrees and approximately 35 degrees, or between approximately 25 degrees and approximately 35 degrees. The neck and can body are configured such that the outer diameter of the seam is less than an inner diameter of the base such that a base of a first can be stacked onto the end of a second can. An outer diameter of the seam can be approximately the same as or greater than an inner diameter of the base such that an end of a first beverage can is stackable onto a base of a second beverage can in an interference fit. And the base can have in interior, reforming grove into which the end fits.

An average wall thickness of the neck is thicker than the average wall thickness of the cylindrical sidewall. In particular, the average wall thickness of the neck can be thicker than the average wall thickness of the cylindrical sidewall by between approximately 0.001 inches and approximately 0.0035 inches, or between approximately 0.0015 inches and approximately 0.0025 inches, or approximately 0.002 inches. Further, where the metal is aluminum, such as a 3000 series allow, a ratio of can wall thickness measured in units of ten-thousandths of an inch to can body diameter measured in units of inches is less than approximately 25, preferably between 12 and 40, between 16 and 32, between 19 and 28, between 20 and 26, and in the embodiment illustrated in the figures, between 22 and 24. When the metal is steel, the ratio of can wall thickness measured in units of ten-thousandths of an inch to can body diameter measured in units of inches is less than approximately 16, preferably between 7 and 25, between 10 and 20, between 11.5 and 18, or between 12.5 and 17.

In general, the can body should be conventionally sized, such as having a diameter of between 2.0 and 3.0 inches, or between approximately 2.125 inches and approximately 2.75 inches, and have an average sidewall thickness between 0.003 inches and 0.005 inches.

DETAILED DESCRIPTION

The present invention encompasses container or can bodies, and can assemblies employing the bodies, that are suitable for use with carbonated beverages. The ends seamed onto the can bodies encompass removable aperture panels, such as ends known as "full aperture ends," and ends having a hinged panel that employ a stay-on-tab. Copending patent application No. 61/708308, entitled "Beverage Can Ends Suitable For Small Diameters," describes ends that may be employed with the cans described herein.

Figure 2:
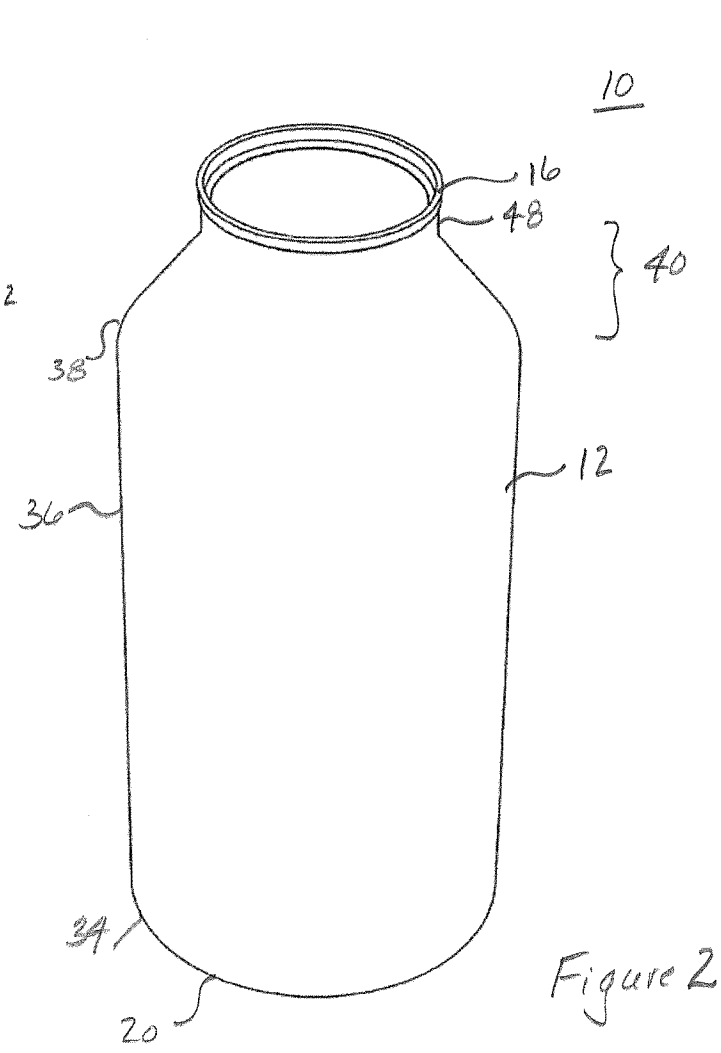
FIG. 2 is a perspective view of the beverage can of FIG. 1 illustrating the removable panel of its full aperture end removed.
Figure 1:
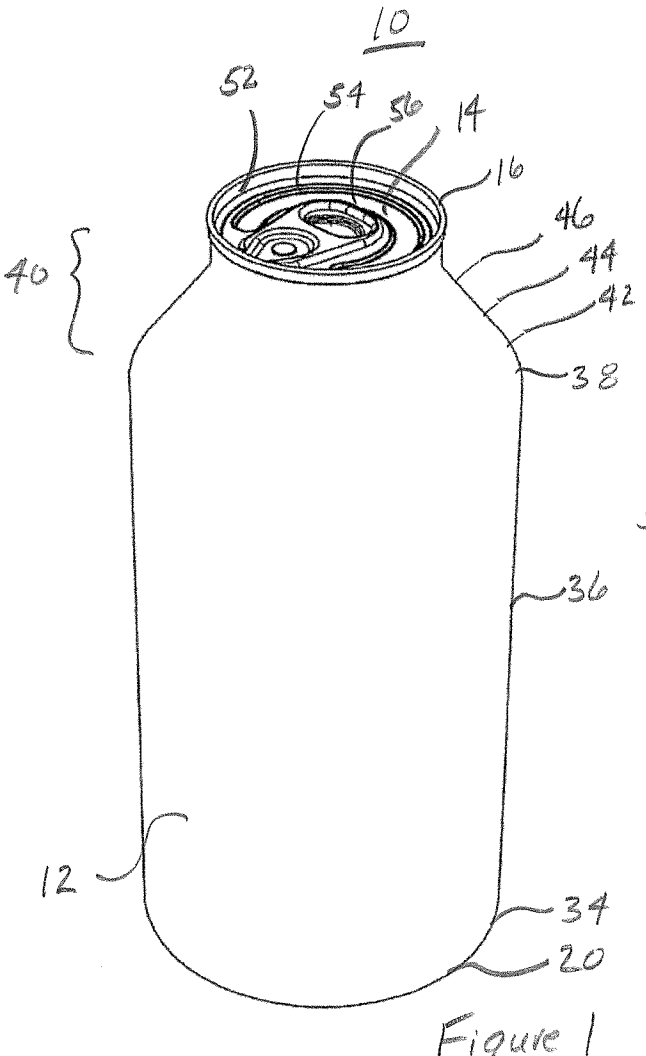
FIG. 1 is a perspective view of a beverage can including a can body illustrating an embodiment of the present invention and an exemplary end affixed to the can body. The exemplary an end is a full aperture beverage end having its tab in its at rest position. The end is affixed to a beverage can that is highly necked.

Referring generally to the figures, beverage can assembly 10 includes a can body 12 and a can end 14 that are joined at a seam 16, which preferably is a conventional double seam common to beverage cans. Reference numeral 14 refers generally to seamed-on beverage can ends. FIG. 1 illustrates a can 10 in its assembled state. FIG. 2 illustrates a full aperture type end in its fully open state in which a removable portion of a center panel 56, which is defined by a score, has been detached and removed from the remainder of end 14.

The present invention is not limited to a particular can size, can materials, end material, or end size except where expressly set out in the claims. Accordingly, to illustrate aspects of the present invention, a 211 (66 mm) size can body shown in the figures is highly necked, which necking may be performed by conventional necking machinery and techniques, as will be understood by persons familiar with can making technology. Preferably can body 12 is a one-piece, drawn and ironed beverage can body formed of an aluminum alloy, such as a 3000 series alloy. Alternatively can body 12 can be made of conventional steel, which encompasses steel of any reduction (that is, SR or DR), temper, and plating parameters. Unless otherwise specified, the description of can body 12 applies equally to aluminum and steel components, as will be understood by persons familiar with drawn and ironed can body technology.

Figure 6:
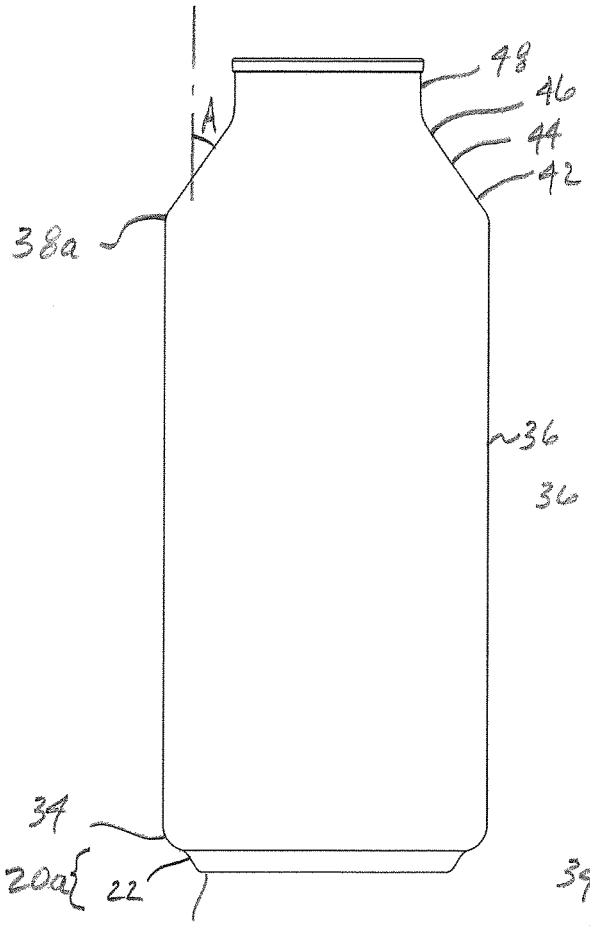
FIG. 6 is a side view of a beverage can according to an embodiment of an aspect of the present invention, illustrating sharp transitions.
Figure 7:
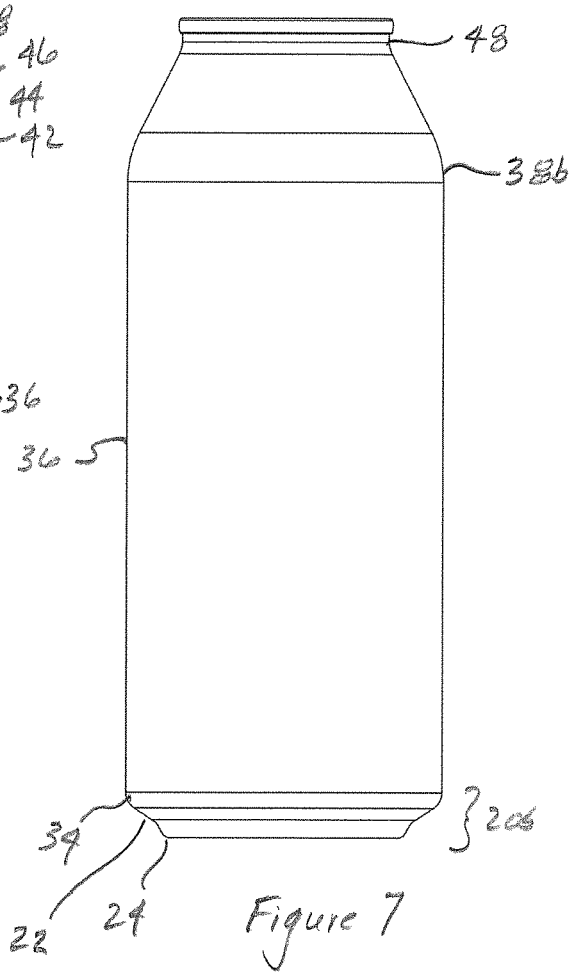
FIG. 7 is a side view of a beverage can according to a second embodiment of the present invention illustrating a curved transition.
Figure 8:
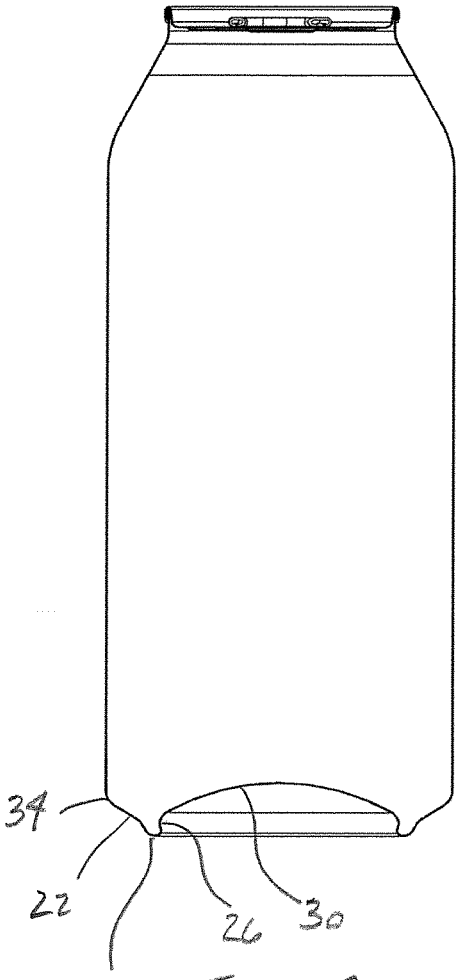
FIG. 8 is a cross sectional view of the can of FIG. 6.

Can body 12 includes a base 20, a body sidewall 36, and a neck 40. Base 20 includes a base outer wall 22 that extends downwardly to a standing ring 24 that is rounded in cross section, as best shown in FIGS. 6 through 8. A base inner wall 26 extends upwardly from standing ring 24. Optionally, inner wall 26 includes a groove that is formed by reforming the base according to well-known base reforming processes. A central dome 30 extends between upper ends of base inner wall 26.

Body sidewall 36 extends from a shoulder or transition 34 at the sidewall's lowermost point. Transition 34 extends between sidewall 36 and base outer wall 22. Body sidewall 36 preferably is cylindrical and, for aluminum can bodies, has an average wall thickness of between 0.003 inches and 0.005 inches, more preferably between 0.0034 inches and 0.0043 inches. A body sidewall thickness for a steel can body preferably is between 0.0020 and 0.0028 and more preferably between 0.0023 and 0.0025.

The thickness of sidewall 36 will preferably be generally uniform within the range of normal manufacturing tolerances for wall ironing, such as within 15% of the mean, although other configurations are contemplated. The can body sidewall 26 preferably has a diameter that is uniform and between approximately 2.0 inches and 3.0 inches, and preferably between approximately 2.125 inches and approximately 2.75 inches, and preferably a 211 size.

A transition 38 extends from an upper portion of sidewall 36. FIG. 6 illustrates a sharp transition, which is designated as transition 38*a*. FIG. 7 illustrates a curved transition, which is designated as transition 38*b*. Letter appendages identify embodiments while the reference number without a letter appendage identifies the parts generally to compass all embodiments.

Neck 40 includes a lower portion 42, a middle portion 44, an upper portion 46, and a stub portion 48. Preferably, portions 42, 44, and 46 are straight in transverse cross section, as shown for example in FIG. 6, such that neck 40 has a smooth taper. Stub 48 encompasses any height, and preferably the height of stub 48 is less than 0.375 inches and more preferably approximately 0.125 inches, as a purpose for stub portion 48 is to provide space for the rollers during the seaming operation. Neck 40 is formed by a conventional necking operation, and encompasses smooth and stepped shapes. The present invention is not limited to straight necked portions or stepped neck portions, but rather encompasses any structure, including curves or a combination of curved and straight section, and including additional structure such as ribs or shoulders.

Preferably, the neck 40 is inclined from vertical by an angle A (as illustrated in FIG. 6) of at least 15 degrees, preferably between approximately 15 degrees and approximately 45 degrees, more preferably by an angle of between approximately 20 degrees and approximately 35 degrees, and even more preferably by an angle of between approximately 25 degrees and approximately 35 degrees. For necks that are substantially straight in cross section, neck angle of inclination can be measured along the length of neck 40 excluding the stub portion. For necks that include curves or steps or bumps, as will be understood by persons familiar with beverage can necking technology, the neck angle of inclination can be measured point to point between a point at the bottom of the neck near the transition between the neck and the can body sidewall and a point at the top of neck near the transition between the neck and the stub. For necks having a shape other than a straight line in cross section, the neck may be configured such that no tangent at any point on the curve or shoulder is inclined more than 45 degrees.

Neck heights can be calculated from the can body diameter and end diameter and neck angle. For example, a 211 can body to a 200 can end is a reduction of approximately 0.034 inches (radius), which yields at height of 1.28 inches for a 15 degree neck angle A and a height of 0.49 inches for a 35 degree neck wall angle A.

Preferably neck 40 has an average wall thickness that is thicker than the average wall thickness of the cylindrical sidewall 36, such as having a neck average wall thickness that is greater than the average sidewall wall thickness of the cylindrical sidewall by between approximately 0.001 inches and approximately 0.0035 inches, more preferably by between approximately 0.0015 inches and approximately 0.0025 inches, and in the preferred embodiment by approximately 0.002 inches. The increased neck thickness and the neck angle A in the preferred ranges enhances the strength of can 10 and the ability of the neck to withstand the necking process, such as preventing collapse or wrinkling.

Container 10 can be represented by numeric ratios that are consistent with the advantages described herein. For example, can body 12 may have a diameter (that is, at sidewall 36) that is between 40% and 90% greater than a diameter of the seamed end, more preferably between 40% and 80% greater, more preferably between 45% and 60% greater, and even more preferably between 48% and 55% greater than the diameter of the seamed end, depending on the particular embodiment.

In another representation of container 10 in which the can is formed of a conventional aluminum alloy, such as a 3000 series allow, a ratio of can sidewall 36 wall thickness measured in units of ten-thousandths of an inch (0.0001 inches) to can body diameter measured in units of inches is less than approximately 25, preferably between 12 and 40, more preferably between 16 and 32, between 19 and 28, between 20 and 26, and preferably between 22 and 24. For a can formed of a conventional steel alloy, the ratio of can sidewall 36 wall thickness measured in units of ten-thousandths of an inch (0.0001 inches) to can body diameter measured in units of inches is less than approximately 16, preferably approximately between 7 and 25, more preferably approximately between 10 and 20, approximately between 11.5 and 18, and preferably between approximately between 12.5 and 17. The can body thickness used for the above ratios may be measured at or near the top of the cylindrical sidewall 36 just below the shoulder. The inventors believe that metal bottles and aerosol cans have high material thicknesses relative to their diameters such that their ratios are greater than the ranges above, due to the differing product requirements.

Figure 9:
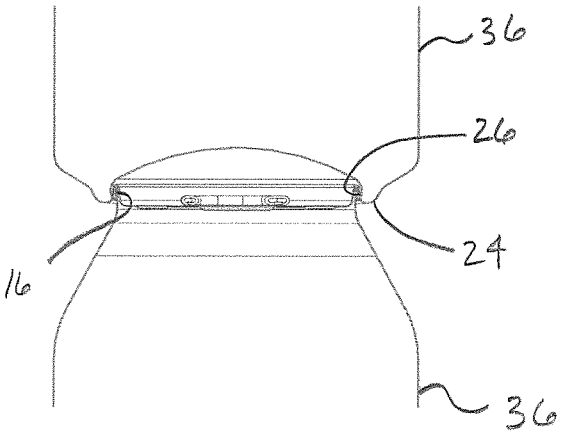
FIG. 9 is a cross sectional view of a first can stacking onto a second can.

Can 10 may be configured such that an outer diameter of seam 16 is approximately the same as or greater than an inner diameter of the standing ring 24 or inner wall 26 such that an end of a first beverage can is insertable or stackable into a base of a second beverage can in a loose fit or a sliding fit. Alternatively, the inner diameter of the standing ring and the outer diameter of the seam may be configured in an interference fit (that is, in which an outer diameter of seam 16 is the same as or greater than the inner smallest diameter of inner wall 26 or standing ring 24). In the embodiment of FIGS. 8 and 9, inner wall 26 includes an undercut or groove formed by reforming.

Can body 12 may have a neck 40 such that seam 16 formed by the combined can body and end preferably has a diameter that is smaller than a 211 size, and therefore end 14 has a size smaller than 211. For example, a 211 can body (or other can body diameter, such as a 58 mm can body) can be necked to correspond to any end size 200 or smaller, such as the 112 (44 mm) or 108 (38 mm) end sizes illustrated in copending patent No. 61/708308, entitled "Beverage Can Ends Suitable For Small Diameters." Even though the ends disclosed herein are not limited to any material or to any diameter or material, they are especially advantageous for smaller end sizes and/or cans having a significant magnitude of necking such that a 200 diameter end or smaller is preferred. End 14 may be formed of a 5000 series aluminum alloy, as is conventional, although the smaller end size may enable other materials, such as an end formed of a 3000 series alloy.

Can end 14 in its unseamed state (not shown in the Figures) includes a peripheral curl that upon seaming forms seam 16 with a portion of can body 12. As illustrated in FIG. 1, end 14 includes a wall 52 extending inwardly from seam 16. End 14 may also include an annular reinforcing bead 54 extending inwardly from wall 52. A center panel 56 extends inwardly from bead 54. Alternatively, the center panel 56 may extend inwardly from wall 52. The end may also have a panel wall between the reinforcing bead and center panel, such as panel walls that form a curve or a chamfer. Reference numeral 56 is used to refer to embodiments of the center panels of the ends, regardless of size, configuration, and type (that is, removable panel or stay-on-tab or the like). Modern lightweight end shells, such as for example shown in U.S. Pat. Nos. 6,877,941 (Brifcani), 8,157,119 (Lockley), 7,819,275 (Stodd), and 6,499,622 (Neiner) and their commercial equivalents and variations, have a reinforcing bead diameter and a center panel diameter that are small relative to the seam diameter compared to older or non-lightweight ends, such as an end known as a B64 end. The can body disclosed herein may be used with modern, lightweight end shells (including other modern lightweight ends not referred to above) or the older end shells, such as a b64 end.

Figure 5:
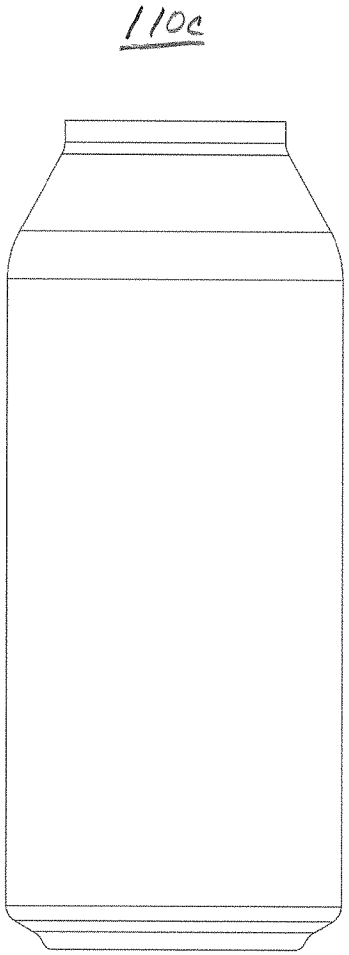
FIG. 5 is side view of a 50 cl can according to an embodiment of the present invention.
Figure 4:
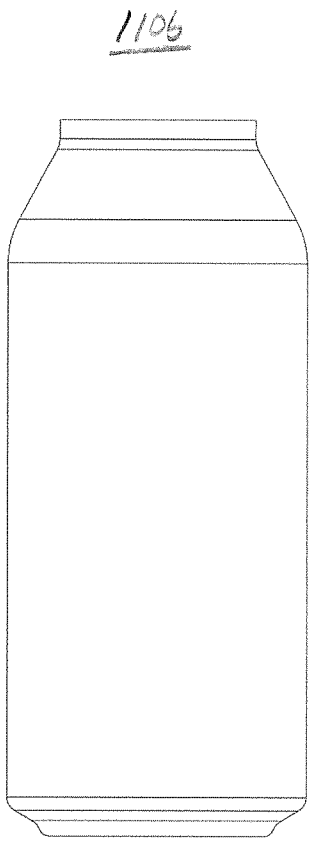
FIG. 4 is side view of a 33 cl can according to an embodiment of the present invention.
Figure 3:
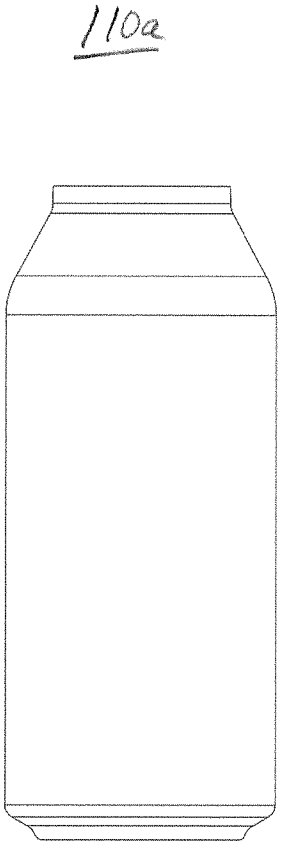
FIG. 3 is side view of a 25 cl can according to an embodiment of the present invention.

FIGS. 3, 4, and 5 illustrate containers 110*a*, 110*b*, and 110*c* having capacities of 25 cl, 33 cl, and 50 cl capacity, respectively. Container 110*a* has a body dimension of 52 mm, an end diameter of 34 mm, and a height of 135 mm. Container 110*b* has a body diameter of 58 mm, an end diameter of 38 mm, and a height of 150 mm. Container 110*c* has a body diameter of 65 mm, an end diameter of 42 mm, and a height of 175 mm. Other preferred sizes are contemplated. For example, a container having a 75 cl capacity may have a body diameter of 73 mm and an end diameter of 48 mm. A container having a 100 cl capacity may have a body diameter of 82 mm and an end diameter of 52 mm. The heights of the 75 cl and 100 cl containers may be chosen according to the parameters understood by persons familiar with can and metal bottle technology based upon considering the disclosure herein.

The can bodies described herein are formed by conventional can making techniques. Can body 12 is formed by a conventional drawing and ironing process, followed by a conventional die necking process for forming neck 40. After the can body goes through a trimming and flanging process, it is ready for being coupled to an end in a double seaming process. The processes described above are well known to persons familiar with can making and seaming technology. The base preferably is a conventional, domed base.

Accordingly, can body 12 is capable of being manufactured on high speed can making equipment, such as at speeds of over 750 cans per minute or over 1,000 cans per minute, as distinguished from the manufacture of metal bottles which is significantly slower. Moreover, the configuration of can 10 is suitable for high speed filling and seaming at speeds of over 1000 cans per minute, as the diameter of the body is large enough to be filled without slowing down conventional filling machines. And can body 10 although manufactured from thin material is strong enough to withstand the axial loads from the filling and seaming machines. For example, a can 10 with thin wall of only 34 t and necks of thickness 54 t have an axial strength of at least 400 N.

The present invention has been illustrated using example of structure and technology for making, and has been defined using groups of features in the summary, which are not intended to be limiting unless specified in the claims as required.

The invention claimed is:

1. A beverage can including:

a drawn and ironed, metal beverage can body including a base, a cylindrical sidewall extending upwardly from the base, and a tapering neck extending upwardly from the sidewall; the base including a standing ring and a dome located within the standing ring; and an end seamed together with an upper end of the neck, the end including a center panel located within the seam, a sealed pour aperture formed in the center panel, the sealed pour aperture is a score formed in the center panel, the end further including a tab adapted for opening the sealed pour aperture, the tab being coupled to the center panel by a rivet, the rivet being positioned between a center of the center panel and the score, the can body having a diameter at the cylindrical sidewall that is between 40% and 100% greater than a diameter of the seamed end outside of the seam.

2. The beverage can of claim 1 wherein a ratio between an average can sidewall thickness measured in units of ten-thousandths of an inch and a can body diameter at the cylindrical sidewall measured in units of inches is less than approximately 25.

3. The beverage can of claim 1 wherein the can body diameter is between 40% and 80% greater than the diameter of the seamed end.

4. The beverage can of claim 1 wherein the can body diameter is between 45% and 60% greater than the diameter of the seamed end.

5. The beverage can of claim 1 wherein the can body diameter is between 48% and 55% greater than the diameter of the seamed end.

6. The beverage can of claim 1 wherein the neck is inclined from vertical by an angle of greater than 15 degrees.

7. The beverage can of claim 1 wherein the neck is inclined from vertical by an angle of between approximately 15 degrees and approximately 45 degrees.

8. The beverage can of claim 7 wherein the neck is substantially straight in cross section between a transition between the neck and the can body sidewall and a transition between the neck and the seam.

9. The beverage can of claim 7 wherein the neck includes curved portions in cross section between a transition between the neck and the can body sidewall and a transition between the neck and the seam, and no tangent at any point on the curve is inclined more than 45 degrees.

10. The beverage can of claim 7 wherein the neck is formed by several step bumps.

11. The beverage can of claim 1 wherein the neck is inclined from vertical by an angle of between approximately 20 degrees and approximately 35 degrees.

12. The beverage can of claim 1 wherein the neck is inclined from vertical by an angle of between approximately 25 degrees and approximately 35 degrees.

13. The beverage can of claim 1 wherein the metal is aluminum and a ratio of can wall thickness measured in units of ten-thousandths of an inch to can body diameter measured in units of inches is less than approximately 25.

14. The beverage can of claim 1 wherein the metal is aluminum and a ratio of can wall thickness measured in units of ten-thousandths of an inch to can body diameter measured in units of inches is between 12 and 40.

15. The beverage can of claim 1 wherein the metal is aluminum and a ratio of can wall thickness measured in units of ten-thousandths of an inch to can body diameter measured in units of inches is between 16 and 32.

16. The beverage can of claim 1 wherein the metal is aluminum and a ratio of can wall thickness measured in units of ten-thousandths of an inch to can body diameter measured in units of inches is between 19 and 28.

17. The beverage can of claim 1 wherein the metal is aluminum and a ratio of can wall thickness measured in units of ten-thousandths of an inch to can body diameter measured in units of inches is between 20 and 26.

18. The beverage can of claim 1 wherein the metal is aluminum and a ratio of can wall thickness measured in units of ten-thousandths of an inch to can body diameter measured in units of inches is between 22 and 24.

19. The beverage can of claim 1 wherein the outer diameter of the seam is less than an inner diameter of the base such that a base of a first can be stacked onto the end of a second can.

20. The beverage can of claim 1 wherein the metal is steel and a ratio of can wall thickness measured in units of ten-thousandths of an inch to can body diameter measured in units of inches is less than approximately 16.

21. The beverage can of claim 1 wherein the metal is steel and a ratio of can wall thickness measured in units of ten-thousandths of an inch to can body diameter measured in units of inches is between 7 and 25.

22. The beverage can of claim 1 wherein the metal is steel and a ratio of can wall thickness measured in units of ten-thousandths of an inch to can body diameter measured in units of inches is between 10 and 20.

23. The beverage can of claim 1 wherein the metal is steel and a ratio of can wall thickness measured in units of ten-thousandths of an inch to can body diameter measured in units of inches is between 11.5 and 18.

24. The beverage can of claim 1 wherein the metal is steel and a ratio of can wall thickness measured in units of ten-thousandths of an inch to can body diameter measured in units of inches is between 12.5 and 17.

25. The beverage can of claim 1 wherein an outer diameter of the seam is approximately the same as or greater than an inner diameter of the base such that an end of a first beverage can is stackable onto a base of a second beverage can in an interference fit.

26. The beverage can of claim 25 wherein the base has in interior, reforming grove into which the end fits.

27. The beverage can of claim 1 wherein the can body is formed of a 3000 series aluminum.

28. The beverage can of claim 1 wherein the can body has a diameter of between 2.0 and 3.0 inches.

29. The beverage can of claim 1 wherein the can body is aluminum and has a diameter of between approximately 2.125 inches and approximately 2.75 inches, and the can body has an average sidewall thickness between 0.003 inches and 0.005 inches.

30. The beverage can of claim 29 wherein the average sidewall thickness is between 0.0034 inches and 0.0043 inches.

31. The beverage can of claim 1 wherein the can body is steel and has a diameter of between approximately 2.125 inches and approximately 2.75 inches, and the can body has an average sidewall thickness between 0.0020 and 0.0028 inches.

32. The beverage can of claim 31 wherein the average sidewall thickness is between 0.0023 and 0.0025 inches.

33. The beverage can of claim 1 wherein the can end is a full aperture can end.

34. The beverage can of claim 1 wherein the end further includes a reinforcing bead, and wherein the center panel extends inwardly from the reinforcing bead.

35. A beverage can including:

a drawn and ironed, metal beverage can body including a base, a cylindrical sidewall extending upwardly from the base, and a tapering neck extending upwardly from the sidewall; the base including a standing ring and a dome located within the standing ring; and an end seamed together with an upper end of the neck, the end including a center panel located within the seam, a sealed pour aperture formed in the center panel, the sealed pour aperture is adapted for being opened by a tab;

wherein a ratio between an average can sidewall thickness measured in units of ten-thousandths of an inch and a can body diameter at the cylindrical sidewall measured in units of inches is less than approximately 25, and wherein an average wall thickness of the neck is thicker than the average wall thickness of the cylindrical sidewall.

36. The beverage can of claim 2 wherein the can body has a diameter that is between 40% and 100% greater than a diameter of the seamed end.

37. A beverage can including:

a drawn and ironed, metal beverage can body including a base, a cylindrical sidewall extending upwardly from the base, and a tapering neck extending upwardly from the sidewall; the base including a standing ring and a dome located within the standing ring; and an end seamed together with an upper end of the neck, the end including a center panel located within the seam, a sealed pour aperture formed in the center panel, the sealed pour aperture is a score formed in the center panel, the end further including a tab adapted for opening the sealed pour aperture, the tab being coupled to the center panel by a rivet, the can body having a diameter at the cylindrical sidewall that is between 40% and 100% greater than a diameter of the seamed end outside of the seam, and wherein an average wall thickness of the neck is thicker than the average wall thickness of the cylindrical sidewall.

38. The beverage can of claim 37 wherein the average wall thickness of the neck is thicker than the average wall thickness of the cylindrical sidewall by between approximately 0.001 inches and approximately 0.0035 inches.

39. The beverage can of claim 37 wherein the average wall thickness of the neck is thicker than the average wall thickness of the cylindrical sidewall by between approximately 0.0015 inches and approximately 0.0025 inches.

40. The beverage can of claim 37 wherein the average wall thickness of the neck is thicker than the average wall thickness of the cylindrical sidewall by approximately 0.002 inches.

41. A beverage can including:

a drawn and ironed, metal beverage can body including a base, a cylindrical sidewall extending upwardly from the base, and a tapering neck extending upwardly from the sidewall;

the base including a standing ring and a dome located within the standing ring; and an end seamed together with an upper end of the neck, the end including a reinforcing bead and a center panel located within the seam and extending inwardly from the reinforcing bead, a sealed pour aperture formed in the center panel, the sealed pour aperture defining a pour opening that is capable of being opened upon lifting a tab while the tab is located entirely within the seam;

the can body having a diameter at the cylindrical sidewall that is between 40% and 100% greater than a diameter of the seamed end outside of the seam.

* * * * *